United States Patent [19]

Nishizawa et al.

[11] 4,111,172

[45] Sep. 5, 1978

[54] SYSTEM TO FEED EXHAUST GAS INTO THE INDUCTION PASSAGE OF AN INTERNAL COMBUSTION ENGINE

[75] Inventors: Mamoru Nishizawa; Takashi Hisatomi, both of Yokohama, Japan

[73] Assignee: Nissan Motor Company, Limited, Japan

[21] Appl. No.: 635,700

[22] Filed: Nov. 26, 1975

[30] Foreign Application Priority Data

Nov. 30, 1974 [JP] Japan ..... 49-143810[U]

[51] Int. Cl.[2] ..... F02M 25/06

[52] U.S. Cl. ..... 123/119 A

[58] Field of Search ..... 123/119 A; 137/513.7

[56] References Cited

U.S. PATENT DOCUMENTS

| | | | |
|---|---|---|---|
| 3,606,871 | 9/1971 | Gropp et al. | 137/513.7 X |
| 3,673,993 | 7/1972 | Nakajima et al. | 123/119 A |
| 3,768,452 | 10/1973 | Lewis | 123/119 A |
| 3,800,764 | 4/1974 | Goto et al. | 123/119 A |
| 3,835,827 | 9/1974 | Wolgemuth | 123/119 A |
| 3,885,536 | 5/1975 | Marshall | 123/119 A |
| 3,885,537 | 5/1975 | Diehl | 123/119 A |
| 3,901,202 | 8/1975 | Hollis et al. | 123/119 A |
| 3,930,475 | 1/1976 | Lewis et al. | 123/119 A |
| 3,977,381 | 8/1976 | Fujikawa et al. | 123/119 A |

FOREIGN PATENT DOCUMENTS

| | | | |
|---|---|---|---|
| 2,365,341 | 11/1974 | Fed. Rep. of Germany | 123/119 A |

*Primary Examiner*—Gerald A. Michalsky

[57] ABSTRACT

An EGR (exhaust gas recirculation) control valve is operated to meter the flow of recirculating engine exhaust gases during engine acceleration only and is locked in a lock position to close the EGR passageway in response to a high pressure prevailing in a vacuum chamber of a servo device of the EGR control valve during engine operations excluding acceleration.

11 Claims, 8 Drawing Figures

SYSTEM TO FEED EXHAUST GAS INTO THE INDUCTION PASSAGE OF AN INTERNAL COMBUSTION ENGINE

The present invention relates generally to an exhaust gas recirculation system for reducing the content of nitrogen oxides ($NO_x$) contained in exhaust gases discharged from an internal combustion engine and particularly to an exhaust gas recirculation system improved to recirculate engine exhaust gases into the induction passage during engine acceleration only.

As is well known in the art, internal combustion engines are equipped with exhaust gas recirculation systems to recirculate engine exhaust gases into the induction passages at a ratio proportional to the amount of air drawn into the engine for lowering the temperature of combustion in the engine combustion chambers to reduce the amount of nitrogen oxides produced by high temperature combustion in the combustion chambers in presence of nitrogen.

However, conventional exhaust gas recirculation systems have been constructed to recirculate engine exhaust gases into the induction passages during all engine operations. This has caused an increase in fuel consumption of the engine and deterioration of driveability of a motor vehicle equipped with the engine.

Internal combustion engines discharge exhaust gases containing a large quantity of nitrogen oxides during engine acceleration and exhaust gases containing a small quantity of nitrogen oxides during steady running and deceleration.

It is, therefore, an object of the invention to provide an exhaust gas recirculation system improved to effect the recirculation of engine exhaust gases into the induction passage during engine acceleration only and to inhibit the recirculation of engine exhaust gases into the induction passage during steady running and deceleration so that a decrease in fuel consumption of the engine and an improvement in driveability of the vehicle are accomplished concurrently with the production of nitrogen oxides in the engine combustion chamber being reduced throughout all engine operations.

This and other objects and advantages of the invention will become more apparent from the following detailed description taken in connection with the accompanying drawings in which.

Figure 1:
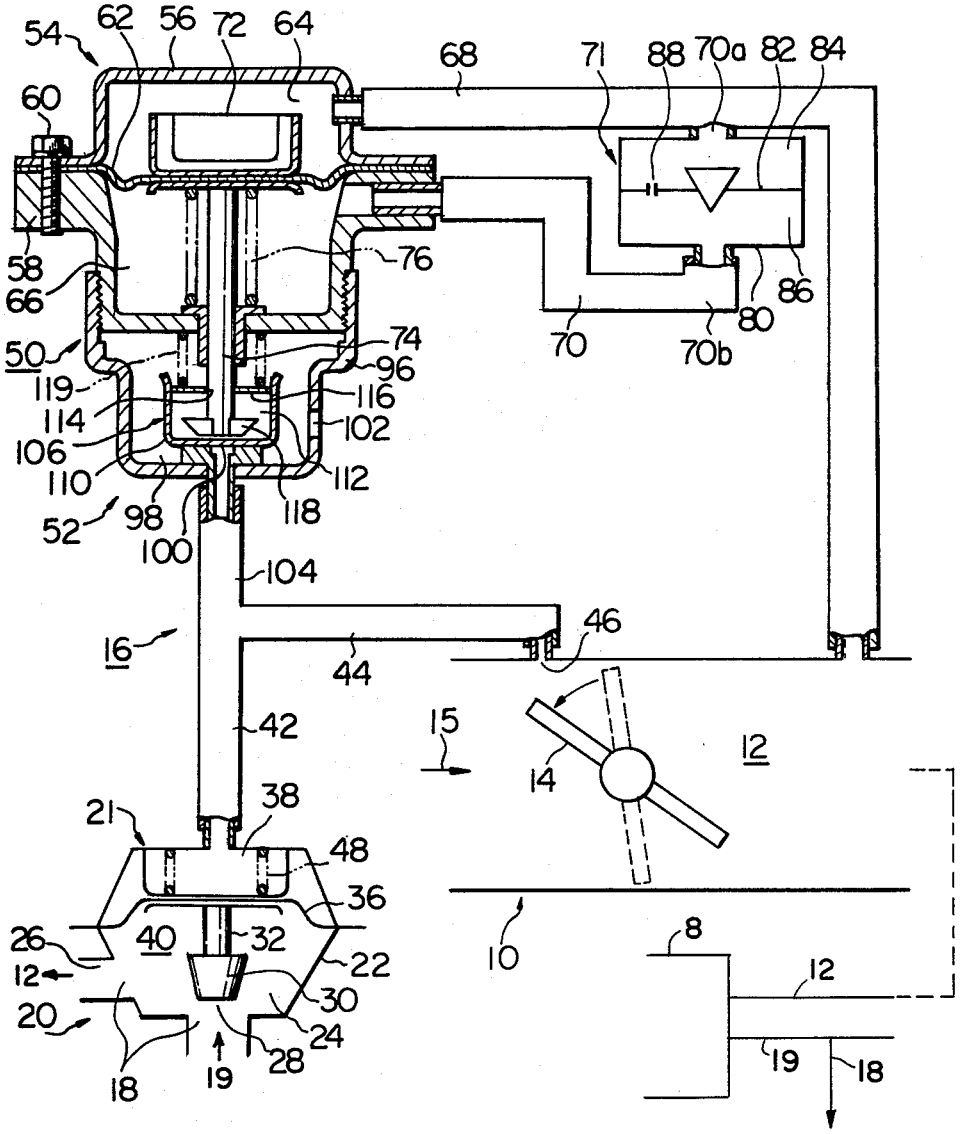
FIG. 1 is a schematic cross sectional view of a first preferred embodiment of an exhaust gas recirculation system according to the invention.

Referring to FIG. 1 of the drawings, there is shown an EGR (exhaust gas recirculation) control system according to the invention, and that portion of an internal combustion engine which is connected with the EGR system, such as, for example, an intake system 10. The intake system 10 is shown as including an induction passageway 12 leading from an air cleaner (not shown) and terminating in an engine combustion chamber (not shown), and a throttle valve 14 rotatably mounted on a part of the body of the induction passage 12 thereacross in such a manner as to control the flow of an air-fuel mixture passing into the intake manifold in the direction of an arrow 15 shown in the drawing.

The EGR system, generally designated by the reference numeral 16, comprises an EGR conduit or passageway 18 communicating at one end with an exhaust gas passageway (not shown) of the engine and at the other end with the induction passage 12 at a position downstream of the throttle valve 14 or an intake manifold (not shown) to recirculate up to a certain portion engine exhaust gases from the engine exhaust gas passage into the induction passage 12, and an EGR control valve 20 disposed in the EGR passageway 18 in such a manner as to meter the flow or amount of engine exhaust gases passing therethrough to the induction passage 12 at a predetermined ratio to that of air drawn into the intake manifold. The EGR valve 20 is operated by an actuator or servo device 21.

The EGR control valve 20 comprises a hollow housing 22 having a valve chamber 24 therein which is connected to the EGR passageway 18 through two ports 26 and 28 and forms a part of the EGR passageway 18, a valve head 30 located in the valve chamber 24 and movable to open and close the port 28, by a valve stem or operating rod 32 fixedly secured to the valve head 30, as shown.

The servo device 21 comprises the housing 22 in common with the EGR valve 20, and a flexible diaphragm 36 dividing the interior of the housing 22 into upper and lower chambers 38 and 40. The upper or vacuum chamber 38 communicates by way of conduits 42 and 44 with a port 46 opening into the induction passage 12 at a point just upstream of the peripheral edge of the throttle valve 14 in its engine idle position essentially closing the induction passage 12, while the lower chamber 40 is open to the valve chamber 24 and accordingly communicates with the EGR passageway 18. The valve stem 32 is centrally fixedly secured at an other end to the diaphragm 36. A compression spring 48 is located in the upper chamber 38 and urges the diaphragm 36 and accordingly the valve head 30 toward a position in which the valve head 30 closes the port 28.

The EGR system comprises a control device 50 constructed and arranged to control the servo device 21 to cause the EGR valve 20 to open the EGR passageway 18 to permit the recirculation of engine exhaust gases to the induction passage 12 only during acceleration of the engine and to cause the EGR valve 20 to close the EGR passageway 18 to inhibit the recirculation of engine exhaust gases to the induction passage 12 during engine running conditions other than acceleration. The control device 50 comprises a control valve 52 and an actuator or servo device 54 for operating the control valve 52.

The servo unit 54 comprises two casing members 56 and 58 which are joined together at their peripheries by suitable fastening means such as bolts 60 (only one shown), and a pressure sensitive deformable partition member such as a flexible diaphragm 62 which is peripherally clamped between the casing members 56 and 58. The diaphragm 62 divides the space defined by the casing members 56 and 58 into upper and lower chambers 64 and 66. The upper chamber 64 communicates with the induction passage 12 at a position downstream of the throttle valve 14 by way of a conduit 68, while the lower chamber 66 communicates with the conduit 68 by way of a conduit 70 provided therein with delay means 71. A stop member 72 is fixedly secured to the diaphragm 62 in the upper chamber 64 and limits the upward movement of the diaphragm 62. An actuator rod 74 is centrally fixedly connected at one end to the diaphragm 62 and extends externally of the lower chamber 66 therethrough and is operatively connected to the control valve 52 as will be described later. A compression spring 76 is disposed between the diaphragm 62 and the casing member 58 and urges the diaphragm 62 into a position to open the control valve 52.

Figure 2:
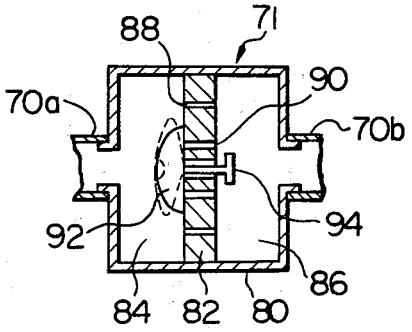
FIG. 2 is a schematic cross sectional view of delay means forming part of the exhaust gas recirculation system shown in FIG. 1.

The delay means 71 is operable to transmit increases in the vacuum in the chamber 64 to the chamber 66 without a time lag when the vacuum in the chamber 64 is increased and to transmit decreases in the vacuum in the chamber 64 to the chamber 66 with a time lag when the vacuum in the chamber 64 is reduced at a rate exceeding a predetermined value. As is best shown in FIG. 2, the delay means 71 comprises a housing 80, and a pressure insensitive partition member 82 dividing the interior of the housing 80 into a first chamber 84 communicating with the conduit 68 by way of a port 70*a* and a second chamber 86 communicating with the lower chamber 66 of the servo unit 54 by way of a port 70*b*. The partition member 82 is unmovable by a pressure differential between the chambers 84 and 86. The partition member 82 is formed therethrough with an orifice 88 and a passage aperture 90 which both provide fluid communication between the chambers 84 and 86. The cross sectional area of the orifice 88 is smaller than that of the passage 90. A pressure responsive deformable valve leaf or valve head 92 is mounted on the partition member 82 in the chamber 84 by suitable fastening means such as a center pin 94 to close and open the passage 90 only. The valve leaf 92 and passage 90 form a check valve which is opened to permit fluid flow from the chamber 86 to the chamber 84 when the vacuum in the chamber 84 is above the vacuum in the chamber 86 and is closed to inhibit fluid flow from the chamber 84 to the chamber 86 when the vacuum in the chamber 84 is below the vacuum in the chamber 86.

Returning to FIG. 1, the control valve 52 comprises a lower casing member 96 which is threaded and screwed on the also threaded casing member 58 and defines a valve chamber 98 therein together with the casing member 58. The lower casing member 96 is formed therethrough with first and second ports 100 and 102 which both open into the valve chamber 98. The first port 100 communicates with the conduits 42 and 44 by way of a conduit 104, while the second port 102 is vented to the atmosphere. A valve head 106 is located in the valve chamber 98 to close and open the port 100. The valve head 106 is held in a position shown in the drawing to close the port 100 when the vacuum in the chamber 64 is below the vacuum in the chamber 66 in excess of a predetermined value. The actuator rod 74 extends from the chamber 66 into the valve chamber 98 and is operatively connected at the other end to the valve head 106 to move it into a position to open the port 100 when the vacuum difference in the chambers 64 and 66 is reduced to a predetermined value.

The actuator rod 74 is connected to the valve head 106 in such a manner as to be unable to move it into the position opening the port 100 even if the actuator rod 74 is more or less moved upwardly owing to vibrations of the engine or a motor vehicle equipped with it or owing to a reduction in the vacuum difference in the chambers 64 and 66 when the valve head 106 is in the position closing the port 100. In other words, the control valve 52 has a so-called lost motion mechanism. For this purpose, the valve head 106 comprises a casing 110 of a box section having therein a space 112 of a suitable height. The actuator rod 74 extends into the space 112 through an aperture 114 formed through a cover 116 of the casing 110. The diameter or cross sectional area of the aperture 114 is larger than that of the actuator rod 74 so that the actuator rod 74 is freely axially slidable with respect to the valve head 106. A flange 118 is fixedly connected to the lower end of the actuator rod 74 and is positioned in the casing 110 at a location spaced apart from the cover 116 when the actuator rod 74 is in a rest position shown in the drawing in which the valve head 106 closes the port 100. The flange 118 is engageable with the cover 116 only when the actuator rod 74 is moved upwardly in excess of a predetermined value from the position shown in the drawing to thereby move the valve head 106 into the position opening the port 100. A compression spring 119 is located between the casing member 58 and the valve head 106 and urges the valve head 106 into the position closing the port 100. The force of the spring 119 is smaller than that of the spring 76 so that the action of the actuator rod 74 overcomes the force of the spring 119 when the diaphragm 62 and the actuator rod 74 are moved upwardly by the action of the spring 76.

Figure 3:
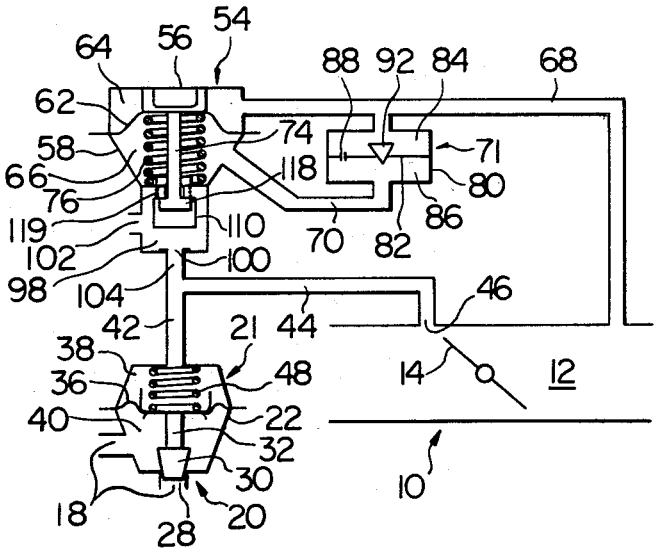
FIGS. 3 to 5 are schematic views showing operating conditions of the exhaust gas recirculation system, shown in FIG. 1, during various engine operations, respectively.

The EGR system 16 thus far described is operated as follows:

When the engine is running steadily with the throttle valve 14 held in a certain open position (reference is made to FIG. 3), the vacuum in the upper chamber 64 of the servo unit 54 is equal to that in the lower chamber 66 thereof. This permits the spring 76 to force the diaphragm 62 and accordingly the actuator rod 74 to the position shown in FIG. 3 to cause the flange 118 of the rod 74 to move the valve head 106 into the position opening the port 100. Accordingly, atmospheric air enters the upper chamber 38 of the servo device 21 by way of the port 102, the valve chamber 98, the port 100, and the conduits 104 and 42 to reduce the vacuum in the chamber 38 below a predetermined value. This permits the spring 48 to lock the diaphragm 36 in the lock position shown in FIG. 3 in which the valve head 30 closes the port 28. Thus, the EGR valve 20 blocks the EGR passageway 18 to interrupt the recirculation of engine exhaust gases to the induction passage 12.

Figure 4:
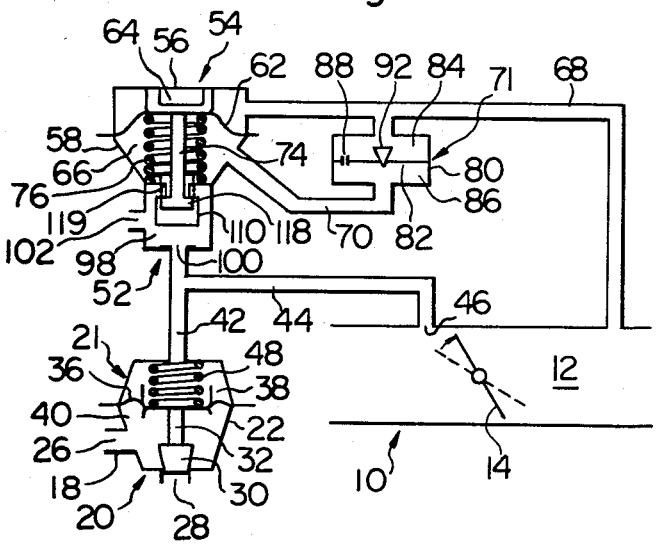

When the throttle valve 14 is turned toward its fully closed position for deceleration of the engine (reference is made to FIG. 4), the vacuum in the chamber 84 of the delay means 71 is increased as compared with the vacuum in the chamber 86 thereof. This causes the valve leaf 92 to bend away from the partition member 82 to open the passage 90. Both the orifice 88 and the passage 99 permit an immediate increase in the vacuum in the chamber 86 to the level of the vacuum in the chamber 84 to instantly eliminate the difference between the pressures in the chambers 64 and 66 of the servo unit 54. Thus, the EGR valve 20 is locked in the lock position to close the EGR passageway 18 to interrupt the recirculation of engine exhaust gases to the induction passage 12, similarly to the event of the steady operation described just above.

Figure 5:
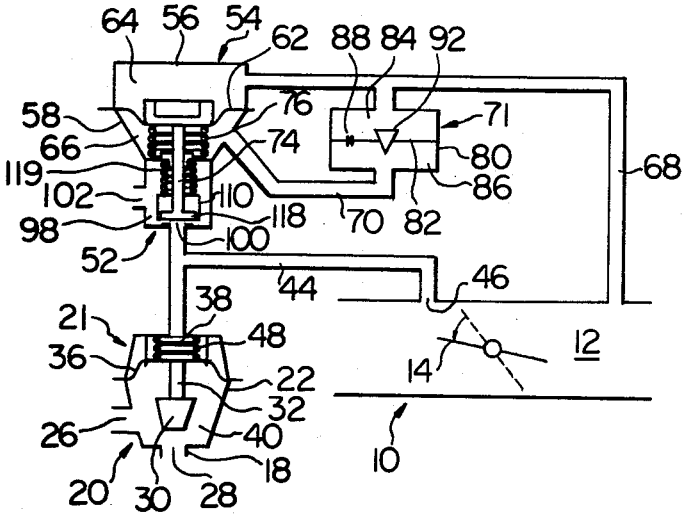

When the throttle valve 14 is turned toward its fully open position for acceleration of the engine (reference is made to FIG. 5), the vacuum in the chamber 84 of the delay means 71 is reduced as compared with the vacuum in the chamber 86 thereof. This causes the valve leaf 92 to be pressed against the partition member 82 to close the passage 90. The orifice 88 prevents sudden application of the vacuum in the chamber 84 to the chamber 86 and causes the vacuum in the chamber 86 to gradually reduce to the level of the vacuum in the chamber 84 with a time lag. Accordingly, the vacuum in the chamber 64 of the servo unit 54 is maintained below the level of the vacuum in the chamber 66 thereof. The diaphragm 62 and the actuator rod 74 are forced by the vacuum difference in the chambers 64 and 66, overcoming the force of the spring 76, to the position shown in FIG. 5 in which the valve head 106 closes the port 100. Accordingly, the chamber 38 of the servo device 21 communicates with the port 46 only and the vacuum in the chamber 38 is increased to the level of the vacuum in the induction passage 12 adjacent to the port 46. The diaphragm 36 is forced by the pressure difference in the chambers 40 and 38, overcoming the force of the spring 48, to the position shown in FIG. 5 in which the valve head 30 opens the port 28. Thus, the EGR valve 20 opens the EGR passageway 18 to permit the recirculation of engine exhaust gases to the induction passage 12 and to meter the flow of recirculating exhaust gases.

Figure 6:
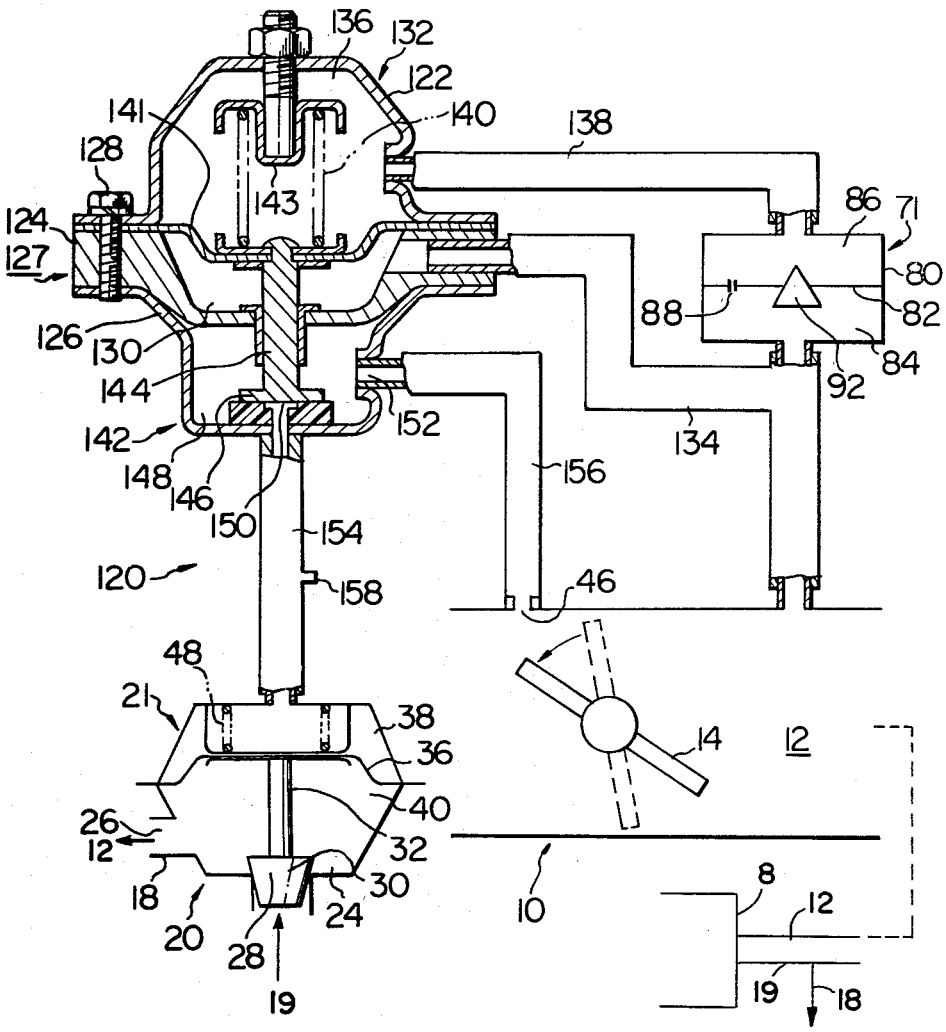
FIG. 6 is a schematic cross sectional view of a second preferred embodiment of an exhaust gas recirculation system according to the invention.

Referring to FIG. 6 of the drawings, there is shown a second preferred embodiment of an EGR system according to the invention. The EGR system, generally designated by the reference numeral 120, is characterized by the following aspects: In FIG. 6, like component elements are designated by the same reference numerals as those used in FIG. 1. Upper, middle and lower casing members 122, 124 and 126 of a control device 127 are peripherally joined together by suitable fastening means such as bolts 128 (only one is shown). A lower chamber 130 of an actuator or servo unit 132 communicates with the engine induction passage 12 at a location downstream of the throttle valve 14 by way of a conduit 134, while a upper chamber 136 of the servo unit 132 communicates with the conduit 134 by way of a conduit 138 provided therein with delay means 71. A compression spring 140 is located in the upper chamber 136 and urges a flexible diaphragm 141 into the position shown in the drawing in which a control valve 142 is closed. It will be thus understood that functionally the upper and lower chambers 136 and 130 correspond respectively to the lower and upper chambers 66 and 64 of the servo unit 54 of FIG. 1. A stop member 143 is mounted on the upper casing member 122. The control valve 142 has no lost motion mechanism and an actuator rod 144 is fixedly connected to a valve head 146 of the valve 142. A valve chamber 148 of the control valve 142 has first and second ports 150 and 152 in place of the ports 100 and 102 of the valve chamber 98 of the control valve 52 of FIG. 1. The first port 150 communicates with the upper chamber 38 of the servo device 21 by way of a conduit 154, while the second port 152 communicates with the port 46 opening into the induction passage 12 at a location just upstream of the fully closed throttle valve 14 by way of a conduit 156. The conduit 154 communicates with the outside atmosphere by way of an opening 158 formed therethrough which has a small cross sectional area.

The EGR system 120 thus far described is operated as follows:

When the engine is running steadily with the throttle valve 14 held in a certain open position, since the vacuum in the chambers 130 and 136 of the servo unit 132 is the same the diaphragm 141 and the actuator rod 144 are forced by the force of the spring 140 to the position shown in FIG. 6 in which the valve head 146 closes the port 150. Accordingly, the chamber 38 of the servo device 21 communicates with only the outside atmosphere by way of the opening 158 and is subjected to the atmospheric pressure. Thus, the EGR valve 20 is locked in the lock position to close the EGR passageway 18 to interrupt the recirculation of engine exhaust gases to the induction passage 12, similarly to the time of the steady operation of the EGR system 16 of FIG. 1.

When the throttle valve 14 is turned toward its fully closed position for deceleration of the engine, the vacuum in the chamber 136 of the servo unit 132 is immediately increased to the level of the vacuum in the chamber 130 thereof, as described hereinbefore with respect to the operation of the EGR system 16 of FIG. 1. Thus, the EGR valve 20 is locked in the lock position to close the EGR passageway 18 to interrupt the recirculation of engine exhaust gases to the induction passage 12, similarly to the time of the steady running of the engine.

When the throttle valve 14 is turned toward its fully open position for acceleration of the engine, since a reduction in the vacuum in the chamber 130 of the servo unit 132 is gradually transmitted to the chamber 136 with a time lag by the delay means 71 the vacuum in the chamber 136 is maintained above the vacuum in the chamber 130. Accordingly, the diaphragm 141 is forced by the vacuum difference in the chambers 130 and 136, overcoming the force of the spring 140, to a position in which the valve head 146 opens the port 150. The chamber 38 of the servo device 21 communicates with the port 46 by way of the port 150 the valve chamber 148 and the conduit 156. As a result, the pressure in the chamber 38 approaches the level of the vacuum in the induction passage 12 adjacent to the port 46. Thus, the EGR valve 20 opens the EGR passageway 18 to permit the recirculation of engine exhaust gases to the induction passage 12 and to meter the flow of recirculating exhaust gases, similarly to the time of operation of the EGR system 16 of FIG. 1 under engine acceleration.

Figure 7:
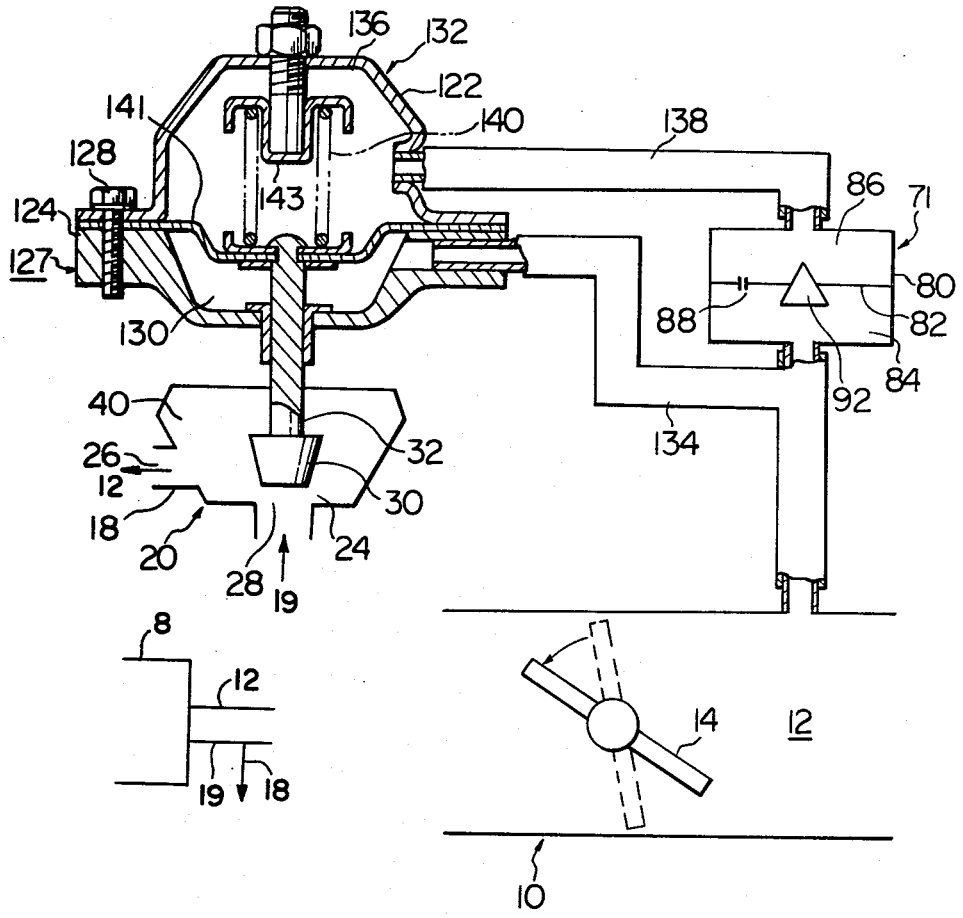
FIG. 7 is a schematic cross sectional view of a modification of the exhaust gas recirculation system shown in FIG. 6.

The EGR system 120 shown in FIG. 6 can be modified in such a manner that the lower casing member 126, the actuator rod 144, the valve head 146, the conduits 154 and 156, and the servo device 21 are omitted, and that the actuator rod 32 of the EGR valve 20 is directly fixedly connected at one end to the diaphragm 141 of the servo unit 132 and the valve head 30 of the EGR valve 20 is arranged to close the port 28 during engine operations excluding acceleration and open the port 28 during acceleration, as shown in FIG. 7 of the drawings.

Figure 8:
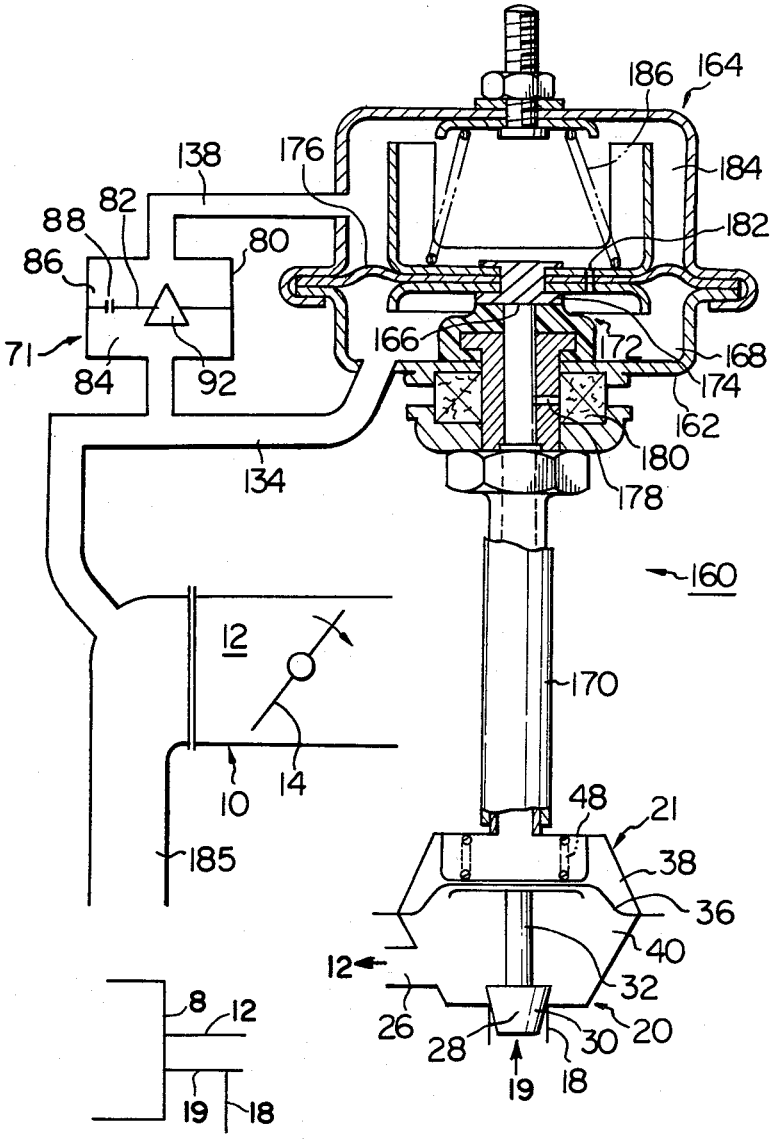
FIG. 8 is a schematic cross sectional view of a third preferred embodiment of an exhaust gas recirculation system according to the invention.

Referring to FIG. 8 of the drawings, there is shown a third preferred embodiment of an EGR system according to the invention. The EGR system, generally designated by the reference numeral 160, is characterized by the following aspects: In FIG. 8, like component elements are designated by the same reference numerals as those used in FIG. 6. Members are omitted which correspond to the lower casing member 126 and the conduit 156 of the EGR system 120 of FIG. 6. Accordingly, a port is not provided which corresponds to the port 46 of FIG. 6. A lower casing member 162 of a actuator or servo unit 164 is formed therethrough with a port 166 opening into a lower chamber 168 thereof. The port 166 communicates with the upper chamber 38 of the servo device 21 by way of a conduit 170. The lower chamber 168 is employed as a valve chamber of a control valve 172. A valve head 174 of the valve 172 is fixedly connected to a flexible diaphragm 176 of the servo unit 164 and is located in the lower chamber 168 to open and close the port 166. The conduit 170 is formed therethrough with an opening 178 providing fluid communication between the conduit 170 and the outside atmosphere and having a small cross sectional area. An annular air cleaner 180 is provided to surround the conduit 170 at a portion thereof having the opening 178. The diaphragm 176 may be formed therethrough with an orifice 182 which provides fluid communication between an upper chamber 184 and the lower chamber 168 and serves, when a vacuum difference exists between the chambers 184 and 168, to eliminate the vacuum difference with a time lag. The conduit 134 communicates with an intake manifold 185 of the engine.

The EGR system 160 thus far described is operated as follows:

When the engine is running steadily or decelerating, the vacuum in the chambers 184 and 168 of the servo unit 164 is the same. This permits a compression spring 186 to force the valve head 174 to the position shown in FIG. 8 to close the port 166. The chamber 38 of the servo device 21 communicates with the port 170 only and the pressure in the chamber 38 approaches the atmospheric pressure. Thus, the EGR valve 20 is locked in the lock position to close the EGR passageway 18 to inhibit the recirculation of engine exhaust gases to the induction passage 12.

When the engine is accelerating, the vaccum in the chamber 168 is maintained below the vacuum in the chamber 184 by delay means 71. The diaphragm 176 is forced by the vacuum difference in the chambers 184 and 168, overcoming the force of the spring 186, to a position in which the valve head 174 opens the port 166. The chamber 38 of the servo device 21 communicates with the intake manifold 185 by way of the conduit 170, the port 166, the chamber 168 and the conduit 134 and the pressure in the chamber 38 approaches the level of the intake manifold vacuum. Thus, the EGR valve 20 opens the EGR passageway 18 to permit the recirculation of engine exhaust gases to the induction passage 12 and to meter the flow of recirculating exhaust gases.

In this instance, if the orifice 182 is formed through the diaphragm 176, fluid enters the chamber 184 from the chamber 168 to gradually reduce the difference between the pressures in the chambers 168 and 184 and to permit the spring 186 to force the diaphragm 176 to the position in which the valve head 174 closes the port 166 after a predetermined period of time from the beginning of the acceleration. The chamber 38 of the servo device 21 communicates with the spring 178 only and the pressure in the chamber 38 gradually approaches the atmospheric pressure. Thus, the EGR valve 20 closes the EGR passageway 18 to inhibit the recirculation of engine exhaust gases to the induction passage 12.

It will be appreciated that the invention provides an exhaust gas recirculation system improved to permit the recirculation of engine exhaust gases into the induction passage during engine acceleration only and to interrupt the recirculation of engine exhaust gases into the induction passage during steady running and deceleration so that it provides the effects that the production of nitrogen oxides is restricted to a low level throughout all engine operations and concurrently fuel consumption of the engine and driveability of the vehicle are improved during steady running and engine stall is prevented during deceleration.

What is claimed is:

1. An exhaust gas recirculation control system in combination with an internal combustion engine including an induction passageway providing communication between the atmosphere and the engine for conducting air thereinto, a throttle valve rotatably mounted in the induction passageway, and an exhaust gas passageway providing communication between the engine and the atmosphere for conducting thereto exhaust gases emitted from the engine, said exhaust gas recirculation (EGR) control system comprising an EGR passageway providing communication between the exhaust gas passageway and the induction passageway for recirculating exhaust gases of the engine thereinto, an EGR control valve disposed in said EGR passageway for controlling the flow rate of engine exhaust gases recirculated into the induction passageway, a housing having therein first and second chambers, a flexible diaphragm separating said first and second chambers from each others, first passage means communicating at one end with the induction passageway downstream of the throttle valve and at the other end with said first chamber, second passage means communicating at one end with said first passage means and at the other end with said second chamber, a pressure insensitive partition located in said second passage means to divide same into first and second sections which communicate respectively with said first passage means and said second chamber, said partition being unmovable by a pressure differential between said first and second sections, said partition being formed therethrough with an orifice and an aperture each of which provides communication between said first and second sections, a check valve for closing said aperture in response to a vacuum in said first section which is below the vacuum in said second section for reducing the vacuum in said second chamber with a time lag when the vacuum in said first chamber is reduced and for opening said aperture in response to a vacuum in said first section which is above the vacuum in said second section for increasing the vacuum in said second chamber without a time lag when the vacuum in said first chamber is increased, and operating means for causing said EGR control valve to open said EGR passageway and to control the flow rate of recirculated engine exhaust gases in response to the vacuum in said second chamber which is reduced with said time lag and for causing said EGR control valve to close said EGR passageway to prevent the recirculation of engine exhaust gases into the induction passageway in response to the vacuum in said second chamber which is increased without said time lag.

2. An exhaust gas recirculation system as claimed in claim 1, in which said operating means comprises an actuator for operating said EGR control valve and having a fluid chamber alternatively subjected to a vacuum existing in said induction passage and a pressure near the atmospheric pressure, said EGR control valve being responsive to said vacuum in said fluid chamber to be operated to control the flow of said engine exhaust gases and to said pressure in said fluid chamber to close said EGR passageway to inhibit the recirculation of engine exhaust gases into said induction passageway, and a control device connected to said actuator and constructed and arranged to cause said fluid chamber to be subjected to said vacuum to operate said EGR control valve during engine acceleration and to cause said fluid chamber to be subjected to said pressure to cause said EGR control valve to close said EGR passageway during engine operations excluding acceleration.

3. An exhaust gas recirculation system as claimed in claim 2, in which said control device comprises a first conduit communicating at one end with said fluid chamber of said actuator, a second conduit connected at one end to said first conduit and subjected at the other end to vacuum in said induction passageway at a position just upstream of the peripheral edge of an engine throttle valve in its fully closed position, a control valve comprising a housing having a valve chamber formed therein and first and second ports both opening into said valve chamber, said first port communicating with the other end of said first conduit, said second port communicating with the outside atmosphere, a valve head located in said valve chamber and closing said first port during acceleration of said engine and opening said first port during engine operations excluding acceleration, an actuator rod connected at one end to said diaphragm and at the other end to said valve head and extending into said valve chamber through said second chamber, and biasing means urging said diaphragm and said actuator rod into a position in which said valve head opens said first port.

4. An exhaust gas recirculation system as claimed in claim 3, in which said valve head comprises a casing of a box section and formed through a cover thereof with an aperture, the cross sectional area of said aperture being larger than that of said actuator rod said actuator rod extending into said casing through said aperture and having a flange which is fixedly connected to said other end thereof and is positioned in said casing at a location spaced from said cover when said actuator rod is in a rest position in which said valve head closes said first port, said flange being engageable with said cover to move said valve head into a position to open said first port when said actuator rod is moved from said rest position in excess of a predetermined value, and biasing means urging said casing into a position to close said first port.

5. An exhaust gas recirculation system as claimed in claim 1, in which said check valve comprises a pressure sensitive deformable valve leaf mounted on said partition member in said first chamber to open and close said passage.

6. An exhaust gas recirculation system as claimed in claim 1, in which said operating means comprises a third chamber separated from said second chamber and communicating with the atmosphere and having a port opening therefrom externally of said third chamber, a second control valve disposed for alternatively closing and opening said port, said diaphragm being operatively connected to said second control valve for causing same to close said port when the fluid pressure in said first chamber is above the fluid pressure in said second chamber and to open said port when the fluid pressure in said first chamber is equal to the fluid pressure in said second chamber, an actuator for operating said EGR control valve, said actuator comprising a second flexible diaphragm having on a side of fluid chamber communicating with said port, passage means for providing communication between said fluid chamber and the induction passageway, said second diaphragm operatively connected to said EGR control valve for causing same to control the flow of said engine exhaust gases in response to closing of said port and to close said EGR passageway in response to opening of said port.

7. An exhaust gas recirculation system as claimed in claim 1, in which said operating means comprises a third chamber separated from said first chamber and having a port opening therefrom externally of said third chamber, passage means for providing communication between said third chamber and the induction passageway, a second control valve disposed for alternatively opening and closing said port, said diaphragm being operatively connected to said second control valve for causing same to open said port when the fluid pressure in said first chamber is above the fluid pressure in said second chamber and to close said port when the fluid pressure in said first chamber is equal to the fluid pressure in said second chamber, an actuator for operating said EGR control valve, said actuator comprises a second flexible diaphragm having on a side a fluid chamber communicating with said port and with the atmosphere, said second diaphragm being operatively connected to said EGR control valve for causing same to control the flow of said engine exhaust gases in response to opening of said port and to close said EGR passageway in response to closing of said port.

8. An exhaust gas recirculation system as claimed in claim 1, in which said operating means comprises an operating rod connecting said diaphragm to said EGR control valve for causing same to control the flow of said engine exhaust gases when the fluid pressure in said first chamber is above the fluid pressure in said second chamber and to close said EGR passageway when the fluid pressure in said first chamber is equal to the fluid pressure in said second chamber.

9. An exhaust gas recirculation system as claimed in claim 1, in which said first chamber has a port opening therefrom externally of said first chamber, said operating means comprising a second control valve disposed for alternatively opening and closing said port, said diaphragm being operatively connected to said second control valve for causing same to open said port when the fluid pressure in said first chamber is above the fluid pressure in said second chamber and to close said port when the fluid pressure in said first chamber is equal to the fluid pressure in said second chamber, an actuator for operating said EGR control valve, said actuator comprising a second flexible diaphragm having on a side a fluid chamber communicating with said port and with the atmosphere, said second diaphragm being operatively connected to said EGR control valve for causing same to control the flow of said engine exhaust gases in response to opening of said port and to close said EGR passageway in response to closing of said port.

10. An exhaust gas recirculation control system in combination with an internal combustion engine including an induction passageway providing communication between the atmosphere and the engine for conducting air thereinto, a throttle valve rotatably mounted in the induction passageway, and an exhaust gas passageway providing communication between the engine and the atmosphere for conducting thereto exhaust gases emitted from the engine, said exhaust gas recirculation (EGR) control system comprising an EGR passageway providing communication between the exhaust gas passageway and the induction passageway for recirculating exhaust gases of the engine thereinto, an EGR control valve disposed in said EGR passageway for controlling the flow rate of engine exhaust gases recirculated into the induction passageway, a housing having therein first and second chambers, a flexible diaphragm separating said first and second chambers from each other, a first conduit connected at one end to the induction passageway downstream of the throttle valve and at the other end to said first chamber, a second conduit connected at one end to said first conduit and at the other end to said second chamber, a housing located in said second conduit to divide same into first and second sections and having therein third and fourth chambers which communicate respectively with said first and second sections, a pressure insensitive partition separating said third and fourth chambers from each other and formed therethrough with an orifice and an aperture each of which provides communication between said third and fourth chambers, said partition being unmovable by a pressure differential between said third and fourth chambers, a check valve for closing said aperture in response to a vacuum in said third chamber which is below the vacuum in said fourth chamber for reducing the vacuum in said second chamber with a time lag when the vacuum in said first chamber is reduced and for opening said aperture in response to a vacuum in said third chamber which is above the vacuum in said fourth chamber for increasing the vacuum in said second chamber without a time lag when the vacuum in said first chamber is increased, and operating means for causing said EGR control to open said EGR passageway and to control the flow rate of recirculated engine exhaust gases in response to the vacuum in said second chamber which is reduced with said time lag and for causing said EGR control valve to close said EGR passageway to prevent the recirculation of engine exhaust gases into the induction passageway in response to the vacuum in said second chamber which is increased without said time lag.

11. An exhaust gas recirculation control system in combination with an internal combustion engine including an induction passageway providing communication between the atmosphere and the engine for conducting air thereinto, a throttle valve rotatably mounted in the induction passageway, and an exhaust gas passageway providing communication between the engine and the atmosphere for conducting thereto exhaust gases emitted from the engine, said exhaust gas recirculation (EGR) control system comprising an EGR passageway providing communication between the exhaust gas passageway and the induction passageway for recirculating exhaust gases of the engine thereinto, an EGR control valve disposed in said EGR passageway for controlling the flow rate of engine exhaust gases recirculated into the induction passageway, a housing having therein first and second chambers, a flexible diaphragm separating said first and second chambers from each other, first passage means communicating at one end with the induction passageway downstream of the throttle valve and at the other end with said first chamber, second passage means communicating at one end with said first passage means and at the other end with said second chamber, a pressure insensitive partition located in said second passage means to divide same into first and second sections which communicate respectively with said first passage means and said second chamber said partition being unmovable by a pressure differential between said first and second sections, said partition being formed therethrough with an orifice and an aperture each of which provides communication between said first and second sections, a check valve for closing said aperture in response to a vacuum in said first section which is below the vacuum in said second section for reducing the vacuum in said second chamber with a time lag when the vacuum in said first chamber is reduced and for opening said aperture in response to a vacuum in said first section which is above the vacuum in said second section for increasing the vacuum in said second chamber without a time lag when the vacuum in said first chamber is increased, a housing having therein a third chamber, a further flexible diaphragm having on a side thereof said third chamber and operatively connected to said EGR control valve, means defining a fourth chamber communicating with the atmosphere, third passage means providing communication between said third and fourth chambers, fourth passage means providing communication between said third chamber and the induction passageway, and a further control valve located in said fourth chamber for alternatively providing and obstructing communication between said fourth chamber and said third means, the first-mentioned diaphragm being operatively connected to said further control valve for moving same into a position, in which said further control valve obstructs said communication, in response to the vacuum in said second chamber reduced with said time lag for causing said EGR control valve to open said EGR passageway and to control the flow rate of recirculated engine exhaust gases and for moving same into a position, in which said further control valve provides said communication, in response to the vacuum in said second chamber increased without said time lag for causing said EGR control valve to close said EGR passageway to prevent the recirculation of engine exhaust gases into the induction passageway.

* * * * *